United States Patent [19]

Kuhn

[11] Patent Number: 4,916,793

[45] Date of Patent: Apr. 17, 1990

[54] STRAIGHTENING OF UNIBODY FRAMES

[75] Inventor: Charles J. Kuhn, 10520 Plainview Ave., Tujunga, Calif. 91042

[73] Assignee: Charles J. Kuhn, Sun Valley, Calif.

[21] Appl. No.: 227,507

[22] Filed: Aug. 2, 1988

[51] Int. Cl.[4] ..... B21D 1/14; B21D 3/12; B23K 31/00

[52] U.S. Cl. ..... 29/402.19; 72/379; 72/705; 228/119; 228/155

[58] Field of Search ..... 72/705, 293, 379; 29/402.19; 228/119, 155

[56] References Cited

U.S. PATENT DOCUMENTS

| | | | |
|---|---|---|---|
| 2,858,872 | 11/1958 | Hougen | 72/392 |
| 3,113,478 | 12/1963 | Hall, Jr. et al. | 72/705 |
| 3,631,705 | 1/1972 | McCaffrey | 72/705 |
| 3,835,692 | 9/1974 | Hoffman | 72/705 |
| 4,770,025 | 9/1988 | Graf | 72/705 |

*Primary Examiner*—Robert L. Spruill
*Attorney, Agent, or Firm*—Christie, Parker & Hale

[57] ABSTRACT

An anchor assembly for use in straightening unibody frame rails comprises a weld plate having at least one internally threaded sleeve projecting from a face of the weld plate. The sleeve is arranged to project into an anchor hole drilled in a metal unibody frame rail to be straightened. The face of the weld plate contacts a side wall of the frame rail in which the anchor hole is drilled so the weld plate can be permanently welded to the side wall of the frame rail with the internally threaded sleeve reinforcing the anchor hole. An anchor plate is releasably fastened to the weld plate on the frame rail. An anchoring bolt extends through an anchor hole in the anchor plate and is threaded into the reinforcing sleeve of the weld plate for releasably fastening the anchor plate to the weld plate. A short length of pulling chain rigidly affixed to an end of the anchor plate is coupled to a pulling chain on a pulling device such as a power post for applying a straightening force to the frame rail via the attachment of the anchor plate to the weld plate. The pulling force is applied with sufficient force necessary to straighten the frame rail without tearing the metal in the frame rail. Following straightening, the anchor plate is removed and the welded-on weld plate is left intact with the straightened frame rail.

19 Claims, 3 Drawing Sheets

STRAIGHTENING OF UNIBODY FRAMES

FIELD OF THE INVENTION

This invention relates generally to the repair of collision damage to motor vehicles, and more particularly, to an anchor assembly for use in straightening unibody frame rails or other body or frame portions prone to being damaged by the pulling forces necessary to straighten the collision damage.

BACKGROUND OF THE INVENTION

Vehicle body and frame repair shops use various types of pulling devices for applying straightening forces to repair collision damage. The straightening forces applied can be substantial, and often as much as ten tons of force are required to straighten damage to an auto body frame rail, for example. In recent years, unibody frame repair has been a problem because the metal now used is rather brittle. As a result, when applying a straightening force up to about ten tons, the metal is often torn or sheared off under the pulling load.

By way of background, the straightening equipment used in auto body and frame repair shops often comprises a post-type pulling apparatus comprising a vertical load support member with a pulley attached at various elevations along the post. A pulling chain is led over the pulley, and one end of the pulling chain is attached to a portion of the vehicle to which the pulling force is applied. The post also carries a tensioning device, generally a hydraulic cylinder arranged so that the other end of the pulling chain is connected to the hydraulic ram for exerting a pulling force on the pulling chain. In use, the power posts rests on the floor of the body shop, and the post is anchored by an anchor chain extending from the post to at least one anchor pot embedded in the floor on the side of the post opposite from the pulling load. These pulling devices can apply substantial loads in order to straighten collision damage and, hence, create a problem with the brittle metal used in today's unibody cars.

Straightening forces applied by these pulling devices often are applied to a pulling point with the use of a clamp at the end of the pulling chain. The clamp has teeth which bite into the metal when applying the pulling force. These clamps often include a wedge which tightens the jaws of the clamp into the metal workpiece with a progressively greater force in proportion to an increase in the pulling force applied by the pulling chain. When pulling forces approach the ten-ton level, for example, the clamp often bites off the metal in the unibody frame rail before sufficient force can be applied to straighten the frame rail.

Once the metal in the frame rail is sheared off, further problems are encountered because the torn-off frame member must either be replaced, or a new frame part must be welded on to substitute for the torn-off portion of the frame.

Thus, there is a need to provide a means for applying pulling forces of a level sufficient to straighten unibody frame rails while avoiding tearing of the metal in the frame rail under such applied loads.

SUMMARY OF THE INVENTION

Briefly, one embodiment of this invention comprises an anchor assembly for use in straightening of unibody frame rails. The assembly includes a weld plate having at least one internally threaded sleeve projecting from a face of the weld plate. The sleeve is arranged to project into an anchor hole drilled in a metal unibody frame rail to be straightened. The face of the weld plate contacts a side wall of the frame rail in which the anchor hole is drilled so the weld plate can be permanently welded to the side wall of the frame rail with the internally threaded sleeve reinforcing the anchor hole. An anchor plate is then releasably fastened to the weld plate on the frame rail. A pulling force of sufficient level to straighten the frame rail is applied to the anchor plate and to the frame rail through its connections to the weld plate. The attached weld plate provides means for reinforcing the frame rail to a level of sufficient resistance to the pulling force necessary to straighten the frame rail without tearing the metal in the frame rail. Once the pulling force is applied and the frame rail is straightened, the anchor plate can be removed from the weld plate and the weld plate can be left permanently affixed to the straightened frame rail.

Thus, the invention provides a means for applying pulling forces of a level sufficient to straighten unibody frame rails while avoiding tearing of the metal in the frame rail under such applied loads.

These and other aspects of the invention will be more fully understood by referring to the following detailed description and the accompanying drawings.

DETAILED DESCRIPTION

Figure 1:
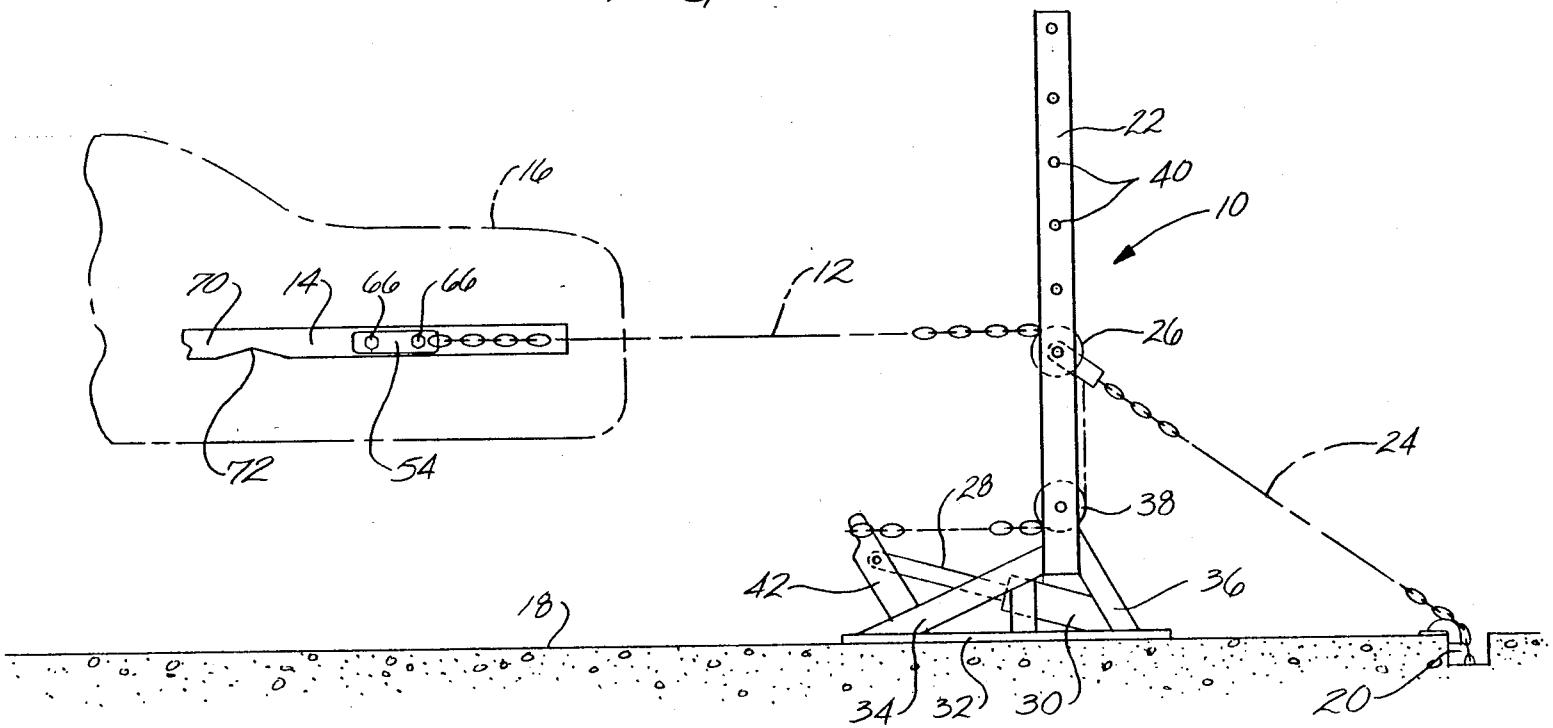
FIG. 1 is a fragmentary, semi-schematic elevation view illustrating use of the anchor assembly of this invention with a power post for applying a pulling load necessary to straighten a unibody frame rail.
Figure 2:
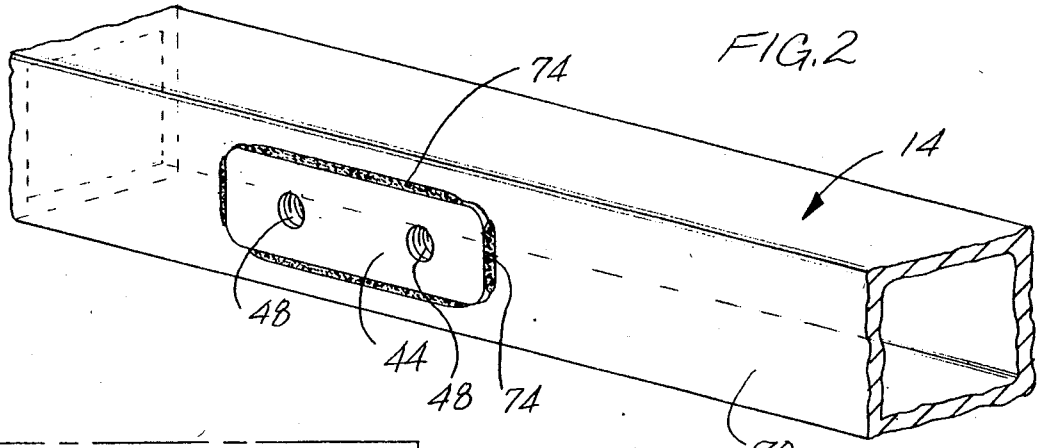
FIG. 2 is a fragmentary, perspective view illustrating a weld plate permanently affixed to a side of a frame rail to be straightened.

FIG. 1 illustrates a pulling apparatus 10 having a pulling chain 12 for applying a pulling force to a workpiece such as a unibody frame rail 14 of a motor vehicle 16 supported in a fixed position above a floor 18 of an auto body and frame repair shop. The pulling chain may be any type of tension line or cable for applying the necessary pulling force to the workpiece. Pulling forces over ten tons are common in the industry. The pulling apparatus 10 is supported on the floor in a free-standing manner as is common with power-post-type pulling apparatus. The opposite end of the pulling apparatus is anchored to an anchor pot 20 embedded in the floor on a side of the pulling apparatus opposite from the vehicle.

Briefly, the pulling apparatus includes an upright post 22 for supporting the pulling chain 12. The force applied to the pulling chain is counteracted by a primary anchor chain 24 extending from the post to the anchor pot. The anchor chain may be any type of tension line or cable capable of resisting the force applied by the pulling chain. The pulling apparatus also includes a pulley 26 for adjusting the elevation of the pulling chain. The opposite end of the pulling chain is attached to a force applying arm 28 of a hydraulic cylinder 30 mounted near the base of the power post. The post preferably comprises a pair of spaced apart and parallel, vertically extending load-resisting members, each of which is rigidly supported upon a base 32 which rests on the floor. The post may be supported on the base by a pair of depending diverging elongated support members 34 and 36 shown on one side of the post in FIG. 1. A pulling chain guide member preferably in the form of a guide pulley 38 is rotatably supported on a shaft extending between the vertical members of the post. The post members can include a series of vertically spaced apart holes 40 in which the shaft of the pulley 26 can be removably mounted for adjusting the elevation of the pull provided by the pulling chain 12.

In order to exert a pulling force on the pulling chain, the hydraulic cylinder 30 is pivotally connected between the support members of the post. The opposite end of the cylinder is pivotally connected to the upper end of a pivot arm 42. A suitable power source, not shown, may be connected to the power cylinder to control operation of the hydraulic piston or ram 28 as it reciprocates, for either applying a force or for being retracted to release the pulling force. The pulling chain 12 passes over the pulley 26 and then preferably passes downwardly along the post and around the guide pulley 38. The pulling chain is then affixed to the upper end of the pivot arm 42. Thus, when the hydraulic cylinder is pressurized, its power-applying piston arm extends outwardly to rotate the pivot arm for applying a pulling force to the pulling chain. The applied force is directed away from the vehicle, as shown in FIG. 1, to apply the pulling force to the frame rail in the conventional manner.

As mentioned previously, the metal used recently in unibody frame rails tends to be brittle, and pulling forces applied by the pulling apparatus at the levels necessary to straighten the frame rail can tear the metal. This problem is particularly serious because the common method for applying the pulling force to a pulling point on the metal is with a wedge clamp which bites into the metal with a progressively greater shearing force as the pulling force on the pulling chain is progressively increased. Thus, it is common for such clamps to shear off the metal at pulling loads which are not sufficient to straighten the damage to the frame rail.

Figure 3:
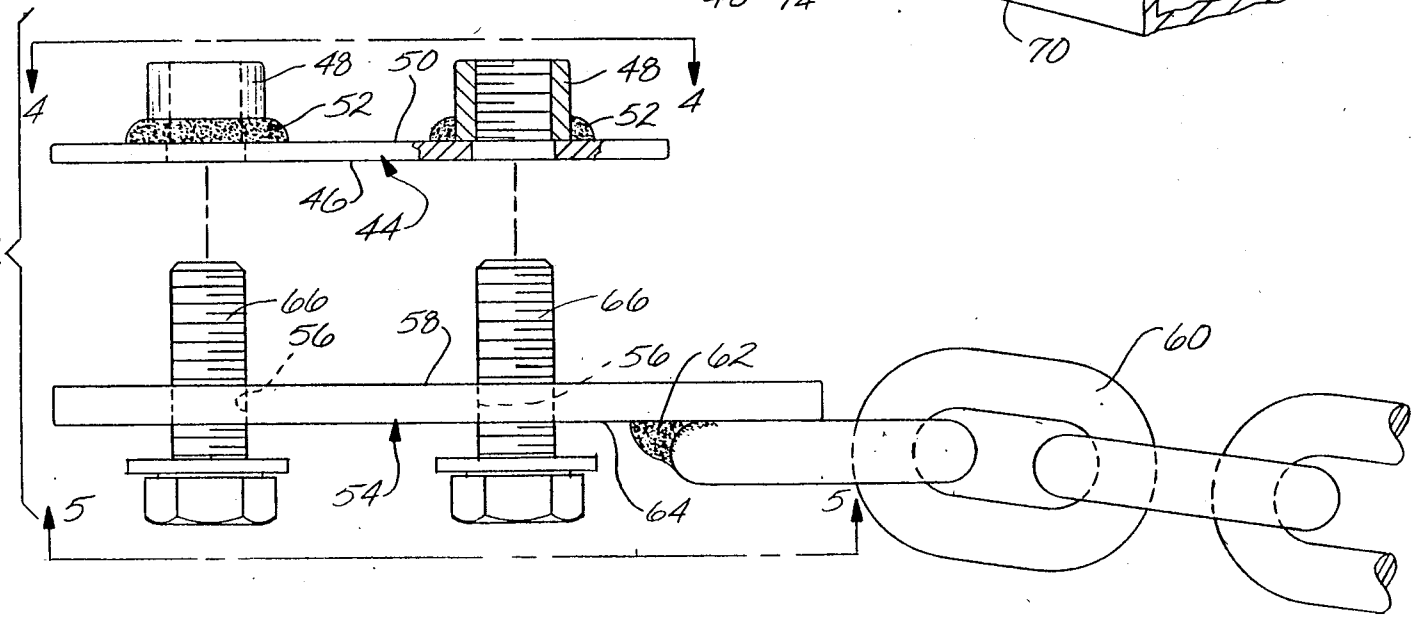
FIG. 3 is an exploded top elevation view illustrating components of the anchor assembly.
Figure 4:
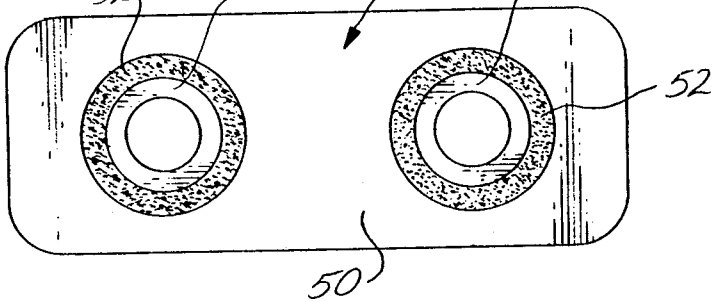
FIG. 4 is an elevation view taken on line 4—4 of FIG. 3.
Figure 5:
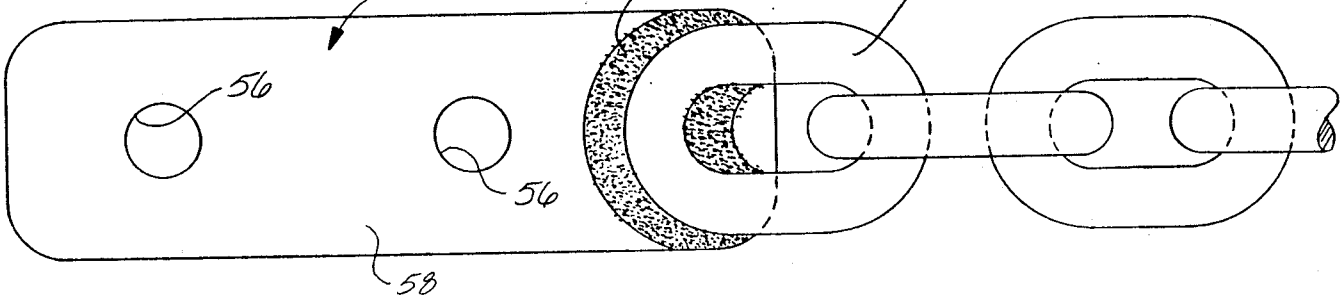
FIG. 5 is an elevation view taken on line 5—5 of FIG. 3 with anchor bolts omitted.

FIGS. 3 through 5 illustrate an anchoring assembly for use in applying pulling forces to a unibody frame rail or other similar workpieces in a vehicle to repair collision damage. The anchoring apparatus is useful in straightening the frame rail or workpiece by making it possible to apply straightening forces of a level necessary to straighten the workpiece without first tearing the metal in it. The invention is especially useful in the more recent unibody frame rail construction using the metal which preferentially tears with loads applied by conventional wedge-type clamps at loads less than necessary to straighten the damage. The anchoring assembly includes a generally rectangular weld plate 44 having a flat rear face 46 and a pair of longitudinally spaced apart internally threaded sleeves 48 projecting from a flat front face 50 of the plate. Separate holes (nonthreaded) are bored through the depth of the weld plate. Each internally threaded sleeve is aligned with a corresponding hole and is rigidly affixed to the weld plate by a corresponding circumferential weld 52 at the base of the sleeve. Preferably, the weld plate is made from a high strength steel capable of being welded to the metal in a unibody frame rail such as the frame rail 14.

The anchoring assembly further includes a rectangular anchor plate 54 also made from high strength steel. The anchor plate has a pair of longitudinally spaced apart holes 56 (unthreaded) bored through the depth of the plate. The holes 56 are alignable axially with the internally threaded passages through the sleeves 48 which project from the face 50 of the weld plate 44. The anchor plate 54 has a flat front face 58 adapted to lie flat against the rear face 46 of the weld plate during use. The anchor plate 54 further includes a short length of anchor chain 60 rigidly affixed to an end of the anchor plate by a weld bead 62. The anchor chain 60 is preferably rigidly affixed to a rear face 64 of the anchor plate at a point spaced from the two holes 56 bored in the plate. The anchor chain is preferably a high-strength steel chain such as a $\frac{3}{8}$-inch chain commonly used for applying pulling forces in the auto body and frame repair industry.

The anchoring assembly further includes a pair of anchoring bolts 66 for extending through the holes 56 in the anchor plate 54 and through the weld plate 44 and for being threaded into the internally threaded sleeves 48 in the weld plate.

The anchor assembly is used by first drilling a pair of holes in an upright side wall 70 of the frame rail. The holes are drilled at a location on the frame rail behind the damaged portion 72 of the frame rail, i.e., between the damaged portion and the power post 10. The holes drilled in the frame rail are spaced apart axially by the same distance between the anchor holes 48 on the weld plate 44.

The weld plate 44 is then placed over the drilled holes so the sleeves 48 on the weld plate extend into the drilled holes, with the front face 50 of the weld plate lying flat against the side wall 70 of the frame rail. The weld plate is then welded to the frame rail, preferably by wire welds 74 along the four side edges of the weld plate. The weld plate is thus permanently affixed to the side of the frame rail behind the damage, with the sleeves 48 projecting into the frame rail to provide permanent reinforced fastening portions on the frame. These fastening portions are of sufficient strength to withstand the pulling force necessary to straighten the frame rail damage. The weld plate spreads the loads over the frame rail and is of sufficient strength to provide an anchor point on the frame rail which will resist the applied straightening loads without tearing the metal. Up to at least about ten tons of pulling force can be resisted by the weld plate attached to the frame rail without tearing the metal, and this includes the recent unibody frame rail metal construction.

In order to apply the pulling force, the anchor plate 54 is then rigidly fastened to the weld plate. The front face 58 of the anchor plate is placed over the weld plate to align the anchor holes 56 of the anchor plate with the internally threaded sleeves 48 of the weld plate. The fastening bolts 66 are then extended through the holes in the weld plate and threaded into the sleeves and tightened against the rear face 64 of the anchor plate. This rigidly fastens the anchor plate to the weld plate which, in turn, is rigidly affixed to the side of the frame rail. The anchor plate is fastened so that the short length of pulling chain 60 extends away from the fixed anchor plate toward the power post 10. The fastening bolts and the anchor plate are of sufficient strength to withstand up to at least about ten tons of pulling force during use.

The end of the chain section 60 is then connected to the end of the main pulling chain 12 on the power post by a conventional coupling (not shown). The hydraulic cylinder on the power post is then pressurized to force the hydraulic ram outwardly to apply a pulling force to the pulling chain 12. The connection of the pulling chain to the frame rail via the anchoring assembly of this invention applies the straightening force to the frame rail necessary to straighten the frame rail without tearing the metal.

When straightening is completed the anchor plate 54 is removed by unfastening the bolts 66, and the weld plate 44 is left intact with the straightened frame rail.

One form of the invention has been described in which the weld plate and anchor plate have a pair of spaced apart anchor holes and anchor sleeves to reinforce a pair of drilled holes in the side of the frame rail. In an alternative configuration, a single anchoring sleeve for reinforcing a single drilled hole can be used in the weld plate, together with an anchor plate having a corresponding single anchoring hole for receiving a single anchoring bolt.

As a further alternative, the anchor plate and weld plate shown in the drawings can be modified to provide a straight die cut between the anchor holes 56 and between the threaded sleeve portions 48, so that the anchor plate and weld plate can each either be used with two fastening bolts, or they can be severed along the die cuts to provide an anchor point for a single anchoring bolt.

It should be understood that the invention has been described in relation to its use with unibody frame rails, but other vehicle body or frame members also can be straightened using the principles of this invention.

What is claimed is:

1. An anchor assembly for use in straightening collision damage to a vehicle workpiece, such as a metal unibody frame rail or the like, comprising:

a weld plate having at least one hole therethrough aligned with at least one internally threaded open passage through a sleeve rigidly and immovably affixed to and projecting from a face of the weld plate, so the weld plate and sleeve are a rigid unit positionable together relative to the workpiece so that when the weld plate is positioned against a side wall of the frame member, the sleeve projects into an anchor hole drilled in the workpiece to be straightened and the hole in the weld plate and the internally threaded open passage in the sleeve are aligned with the anchor hole in the workpiece, with the face of the weld plate contacting a side wall of the workpiece in which the anchor hole is drilled, so the weld plate can be permanently welded to the side wall of the workpiece with the internally threaded sleeve reinforcing the anchor hole;

an anchor plate having at least one opening therethrough;

a fastening bolt for passage through said opening in the anchor plate and for passage into the hole in the weld plate and the internally threaded open passage in the sleeve so the bolt can be tightened against the anchor plate and threaded into the sleeve on the weld plate for releasably fastening the anchor plate to the weld plate; and means on the anchor plate for securing the anchor plate to a pulling chain for applying a pulling force to the workpiece, the weld plate and its rigidly affixed sleeve and the fastened anchor plate being sufficient to resist the pulling force necessary to straighten the workpiece without tearing it.

2. The anchor assembly according to claim 1 in which the weld plate, anchor plate, and fastening bolt resist at least about ten tons of pulling force applied by the pulling chain.

3. The anchor assembly according to claim 1 including means for securing the anchor plate to a pulling chain comprising a short length of pulling chain having a link rigidly and immovably affixed to an end of the anchor plate spaced from the opening in the anchor plate.

4. The anchor assembly according to claim 3 in which the link is in a plane of the anchor plate.

5. The anchor assembly according the claim 1 including at least two longitudinally spaced apart openings in the anchor plate, and including corresponding pairs of longitudinally spaced apart internally threaded sleeves having their passages aligned with corresponding holes on the weld plate and rigidly and immovably affixed to the weld plate.

6. The anchor assembly according to claim 5 in which said pair of longitudinally spaced apart and internally threaded sleeves project from the same face of the weld plate.

7. The anchor assembly according to claim 1 in which the sleeve is welded to a face of the weld plate in alignment with the hole in the weld plate.

8. A method for straightening collision damage to a unibody frame member or the like, comprising:

drilling at least one anchor hole in a side wall of the frame member to be straightened;

positioning a weld plate against the side wall of the frame member, the weld plate having an internally threaded sleeve rigidly affixed thereto in alignment with a hole through the weld plate, the weld plate being positioned against the side wall of the frame member with the rigidly affixed sleeve projecting into the drilled anchor hole;

welding the weld plate to the side wall of the frame member, the weld plate being welded to the frame member so the internally threaded sleeve projects away from the weld plate and into the anchor hole drilled in the frame member for reinforcing the anchor hole;

releasably securing an anchor plate to the side of the weld plate opposite from the frame member by a fastening bolt tightened against the anchor plate and threaded into engagement with the internally threaded sleeve affixed to the weld plate;

applying a pulling force to the anchor plate fastened to the frame member to straighten the frame member without tearing the metal in the frame member; and removing the anchor plate from the weld plate following straightening and leaving the weld plate permanently affixed to the straightened frame member.

9. The method according to claim 8 in which the anchor plate further includes a short length of pulling chain welded to the anchor plate for use in connecting to a pulling chain used to apply the pulling force.

10. The method according to claim 8 in which the anchor plate and weld plate resist at least about ten tons of pulling force without damaging the metal in the frame member while straightening the frame member.

11. The method according to claim 8 in which the weld plate includes a pair of said internally threaded sleeves rigidly affixed to the weld plate and aligned with holes longitudinally spaced apart on the weld plate, and including drilling at least a pair of said anchor holes in the side wall of the frame member for alignment with corresponding internally threaded sleeves inserted into the anchor holes for reinforcing the anchor holes; and including fastening said anchor plate to the weld plate by a corresponding pair of said fastening bolts.

12. The method according to claim 8 in which the frame member being straightened comprises a box like frame rail of a motor vehicle.

13. The method according to claim 12 in which the weld plate is welded to an outer side wall of the frame rail and the pulling force is applied to the outer side wall of the frame rail through the welded-on weld plate.

14. An anchor assembly for use in straightening collision damage to a workpiece such as a unibody frame rail or the like, comprising:

a weld plate having at least one hole therethrough aligned with at least one internally threaded open passage through a sleeve rigidly and immovable affixed to and projecting from a face of the weld plate, so the weld plate and sleeve are a rigid unit positionable together relative to the workpiece so that when the weld plate is positioned against a side wall of the frame member, the sleeve projects into an anchor hole drilled into the workpiece to be straightened, and the hole in the weld plate and the internally threaded open passage in the sleeve are aligned with the anchor hole in the workpiece, with a face of the weld plate contacting a side wall of the workpiece in which the anchor hole is drilled so the weld plate can be permanently welded to the side wall of the workpiece with the internally threaded sleeve reinforcing the anchor hole;

an anchor plate having an anchoring hole for alignment with the hole in the weld plate and the internally threaded sleeve of the weld plate and further including anchoring means on the anchor plate; and a fastening bolt for extending through the anchor hole in the anchor plate and through the hole in the weld plate and the internally threaded open passage in the sleeve for being releasably engaged with the sleeve for releasably fastening the anchor plate to the weld plate, so that a pulling chain attached to the anchoring means on the anchor plate can be used to apply a straightening force to the workpiece, the weld plate and its rigidly affixed sleeve and the attached anchor plate being sufficient to resist the pulling force necessary to straighten the workpiece without tearing it.

15. The anchor assembly according to claim 14 in which the weld plate and anchor plate and fastening bolt resist at least ten tons of pulling force.

16. The anchor assembly according to claim 14 including at least two spaced apart anchor ring holes in the anchor plate and a corresponding pair of holes in the weld plate aligned with a pair of said internally threaded sleeves rigidly affixed to the weld plate.

17. For use in straightening collision damage to a vehicle workpiece or the like, in which the collision damage is straightened by applying a pulling force to one end of a pulling chain attached at its opposite end to an anchor plate having at least one opening therethrough for passage of a fastening bolt used to attach the pulling chain to the workpiece, an improved anchor assembly comprising an elongated weld plate having a face for contacting a side wall of the workpiece to be straightened, the weld plate having at least one hole extending therethrough aligned with at least one internally threaded open passage through a sleeve rigidly and immovably affixed to and projecting from said face of the weld plate, so the weld plate and sleeve are a rigid unit positionable together relative to the workpiece so that when the weld plate is positioned against a side wall of the frame member, the sleeve projects into an anchor hole drilled in the workpiece to be straightened, the weld plate being adapted to be permanently welded to the side wall of the workpiece so the internally threaded sleeve thereon reinforces the drilled anchor hole, the internally threaded sleeve being releasably engageable with the fastening bolt of said anchor plate so the opening in the anchor plate can be aligned with the hole through the weld plate and the open passage in the internally threaded sleeve on the weld plate, and the fastening bolt can be extended through said opening and into threaded engagement with the sleeve for releasably fastening the anchor plate to the weld plate so that a pulling chain attached to the anchor plate can be used to apply a straightening force to the workpiece, the weld plate and its internally threaded sleeve being sufficient to cooperate with the attached anchor plate to resist the pulling force necessary to straighten the workpiece without tearing it.

18. The anchor assembly according to claim 17 in which the weld plate in cooperation with the anchor plate and fastening bolt resist at least ten tons of pulling force.

19. The anchor assembly according to claim 17 including at least two spaced apart anchor holes in the anchor plate and a corresponding pair of holes in the weld plate aligned with a pair of said internally threaded sleeves rigidly and immovably affixed to the weld plate.

* * * * *